US006370737B1

(12) United States Patent
Artzt et al.

(10) Patent No.: US 6,370,737 B1
(45) **Date of Patent: *Apr. 16, 2002**

(54) DRAFTING EQUIPMENT WITH SMALL DOUBLE BELTS

(75) Inventors: Peter Artzt, Reutlingen; Holger Zoudlik, Stuttgart, both of (DE)

(73) Assignee: Deutsche Institute für Textil-und Faserforschung, Stuttgart, Denkendorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/613,347

(22) Filed: Jul. 10, 2000

Related U.S. Application Data

(63) Continuation of application No. 09/031,567, filed on Feb. 26, 1998, now Pat. No. 6,112,509.

(30) Foreign Application Priority Data

| | | |
|---|---|---|
| Mar. 8, 1997 | (DE) | 197 09 580 |
| May 30, 1997 | (DE) | 197 22 528 |
| May 10, 1997 | (DE) | 197 19 773 |

(51) Int. Cl.[7] ..... D01H 5/86
(52) U.S. Cl. ..... 19/246; 19/244
(58) Field of Search ..... 19/150, 236–250, 19/252, 263, 286–288, 304–308; 57/264, 304, 315, 328, 333; 156/382; 198/689.1, 847; 226/95, 170; 428/131, 136, 137

(56) References Cited

U.S. PATENT DOCUMENTS

| | | | | |
|---|---|---|---|---|
| 2,659,936 A | | 11/1953 | Sandelin | |
| 2,774,995 A | | 12/1956 | Sandelin | |
| 3,090,081 A | | 5/1963 | Klein | |
| 3,122,794 A | | 3/1964 | Klein | |
| 3,438,094 A | | 4/1969 | Field, Jr. | |
| 4,290,170 A | | 9/1981 | Brookstein et al. | |
| 5,090,192 A | | 2/1992 | Stahlecker | |
| 5,157,911 A | | 10/1992 | Stahlecker et al. | |
| 5,243,813 A | | 9/1993 | Stahlecker | |
| 5,648,140 A | * | 7/1997 | Vaders | 428/131 |
| 5,706,994 A | * | 1/1998 | Welch et al. | 226/95 |
| 5,819,907 A | * | 10/1998 | Simkowski | 198/689.1 |

FOREIGN PATENT DOCUMENTS

| | | |
|---|---|---|
| DE | 882066 | 7/1949 |
| DE | 1039422 | 12/1955 |
| DE | 29600417.0 | 1/1996 |

OTHER PUBLICATIONS

European Search Report, EP 98 10 2622, 7 pages, Jul. 31, 1998, along with English translation.

* cited by examiner

*Primary Examiner*—John J. Calvert
*Assistant Examiner*—Gary L. Welch
(74) *Attorney, Agent, or Firm*—Dority & Manning, PA

(57) ABSTRACT

A drafting equipment is provided with a small double belt for spinning machines with a fiber bundling zone which follows the pair of output rollers of the main drafting field and is followed by a pair of delivery rollers. A pneumatic compression device is provided between the pair of output rollers and the pair of delivery rollers. A pneumatic compression device is provided with a small perforated belt and a suction device extending on the side of the belt away from the fiber sliver and which sucks air through the fiber sliver between the pair of output rollers and the pair of delivery rollers.

20 Claims, 4 Drawing Sheets

DRAFTING EQUIPMENT WITH SMALL DOUBLE BELTS

RELATED APPLICATIONS

This application is a continuation of U.S. application Ser. No. 09/031,567 filed Feb. 26, 1998 now U.S. Pat. No. 6,112,509.

BACKGROUND OF THE INVENTION

The present invention relates to drafting equipment with small double belts for spinning machines with a fiber bundling zone which follows a pair of output rollers and is followed by a pair of delivery rollers. Drafting equipment of this type is described in DE 43 23 472 (U.S. Pat. No. 5,600,872). Therein a pneumatic compression device is installed between the pair of output rollers and the pair of delivery rollers, said compression device being provided with a small perforated belt and a suction device extending on the side of the small belt away from the fiber sliver and aspiring air through the fiber sliver.

Very good results are achieved with this known device with respect of gathering together and bundling of the fibers, so that a smooth yarn with considerably improved resistance to tearing is spun. It was shown, however, that the pneumatic compression device has relatively high air consumption. When using the conventional traversing apparatus, it may furthermore occur that border fibers are no longer seized securely because they are either outside the perforation zone, or because the negative pressure is not sufficiently strong to bundle them. An enlargement of the perforation zone not only requires more air but decreases the gathering together of the fibers. Increased negative pressure also required more suction capacity. It is however also important for the obtention of uniform spinning results that the optimal state of the drafting equipment, in particular of the compression device, be maintained.

In the known device, a small belt is used without fabric insert in order to release the fibers at the outlet of the delivery roller which had been sucked into the perforation by their ends. These small belts without fabric inserts do not last long.

OBJECTS AND SUMMARY OF THE INVENTION

It is a principal object of the present invention to avoid the described disadvantages and to improve the compression effect of the known device while reducing the suction capacity. Additional objects and advantages of the invention will be set forth in part in the following description, or may be obvious from the description, or may be learned through practice of the invention.

The invention is based on recognition of the fact that only a relatively short distance is necessary for the bundling of the fiber sliver regardless of the staple length of the fibers. The maintenance of the suction air stream as far as into the area of the nip of the delivery cylinder merely serves to maintain the bundling of the fiber sliver up to the entry into the pair of delivery cylinders.

The shortening of the suction zone according to the teaching of this invention results in considerably reduced air consumption and heightened compression effect. Fibers which may have been diverted during transportation are again bundled by further compression in the immediate area before the entry of the fiber sliver into the nip of the delivery cylinder.

By connecting the perforation openings by one or several grooves, a mechanical holding of the bundled fibers is achieved so that the fibers are kept in their bundled position even without suction effect. Furthermore, by providing several grooves, the small belts can be used universally with fiber slivers of different thicknesses.

By using perforation openings with dimensions perpendicular to the direction of fiber movement greater than parallel to the direction of fiber movement, the fiber sliver is safely brought together also during traversing. A certain rough gathering together results, so that the perforation can be kept smaller for the actual compression and so that not only savings in air, but also a closer gathering together of the roving is achieved.

In order to always maintain the effect of the pneumatic compression device at an optimal level, it has proved to be necessary to clean it from time to time. This is especially necessary with a lowered negative pressure. This can be carried out easily by a device wherein the compression device is equipped with a small perforated belt and with a suction device which extends on the side of the belt away from the fiber sliver and which sucks air through the fiber sliver, and also including a blowing air channel that lets out across from the outlet of the suction air channel in a housing-shaped belt cage. This embodiment makes also automation, e.g. in connection with thread piecing, possible. Finally, with the present invention, small belts with long life can be used and reliable release of fibers caught at the outlet from the delivery cylinder can nevertheless be achieved.

An embodiment wherein the perforations of the compression device belts is free of burrs makes it possible to avoid a clogging of the perforation by dust etc. and thereby to avoid lowering of the optimal suction effect.

Further details of the invention are described through the drawings.

DETAILED DESCRIPTION

Figure 1:
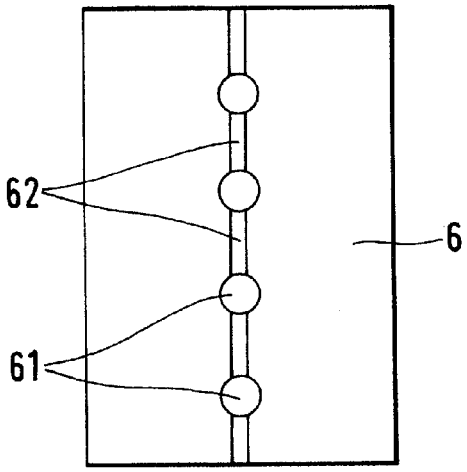
FIGS. 1 and 2 show a small belt with a groove, in a top view and cross-section.

Reference will now be made in detail to the presently preferred embodiments of the invention, one or more examples of which are illustrated in the drawings. Each example is provided by way of explanation of the invention, and not as a limitation of the invention. For example, features illustrated or described as part of one embodiment can be used with another embodiment to yield still a further embodiment. It is intended that the present invention include such modifications and variations as come within the scope and spirit of the invention.

Figure 6:
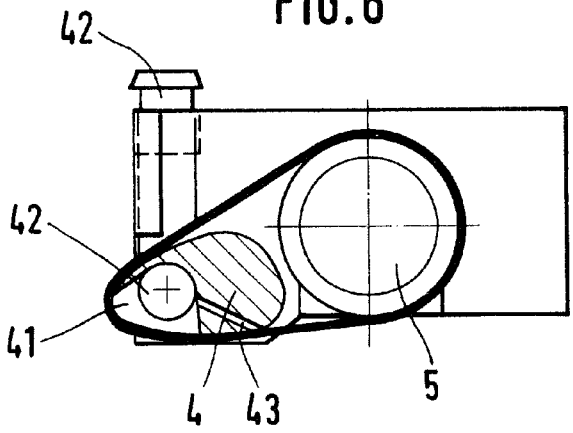
FIG. 6 shows an embodiment with shortened suction zone and additional compression.
Figure 7:
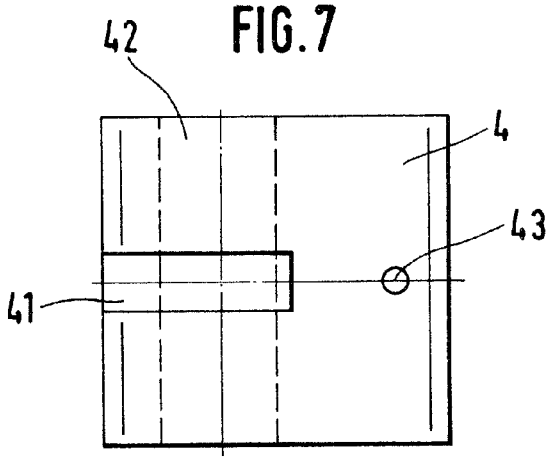
FIGS. 7 and 8 show details of FIG. 6 seen from below and in cross-section.
Figure 8:
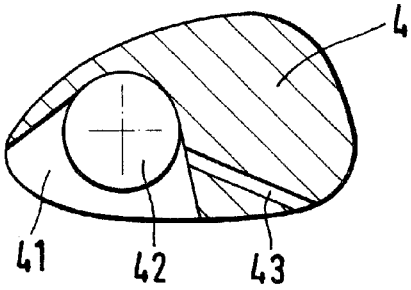

Drafting equipment with double belts for spinning machines with a fiber bundling zone following the pair of output rollers, as shown schematically as 5*a* in FIG. 6, of the main drafting field and which is followed by the pair of delivery rollers 5 has already been described completely in DE 43 23 472 (corresponding to U.S. Pat. No. 5,600,872), so that only the improvements according to the invention of this drafting equipment are discussed below.

FIG. 1 shows the small belt 6 of the pneumatic compression device which is provided with perforations 61, hereinafter compression holes 61, which are connected to each other by a groove 62. The groove 62 is drawn greatly enlarged. It is adapted in its width to the mass of fibers to be gathered together by the compression holes 61. The gathered fibers come to lie in the groove 62 which is sized so that it exerts a certain clamping effect on the fibers. As a result, the bundled fibers are held mechanically until they are under the nip of the delivery roller 5 so that the suction air stream need be shut off only on the bundling immediately after emergence from the pair of output rollers of the drafting equipment.

Figure 2:
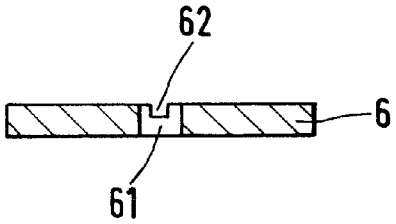

FIGS. 1 and 2 show only one groove 62 which connects the compression holes 61 with each other. However several grooves 62, e.g. three, are advantageously placed parallel to each other. Even when more grooves are used, these are always in the area of the compression holes 61, never further out. The width of these grooves 62 is kept so that they are just able to accept the mass of fibers, so that a certain clamping action results. It has been found that several grooves 62, e.g. three (FIG. 4) are better than only one single groove 62, because the small belt 6 can be used more universally. With very fine yarns one single groove 62 would be too wide and would not exert any clamping action, and on the other hand, too narrow a groove 62 would not be able to receive the mass of thicker yarns. If several grooves 62 are used, e.g. three, the fiber mass only enters the central groove for finer yarns. The outer grooves remain empty. In this manner sufficient clamping action is achieved however. The grooves 62 are furthermore placed symmetrically with respect to the area of the compression holes 61.

Figure 3:
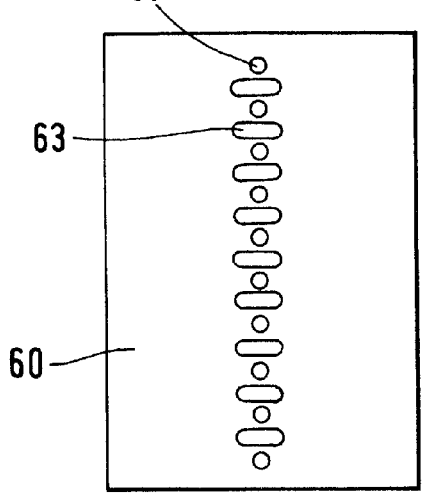
FIGS. 3 and 4 show different embodiments of the small belt with transversal holes, with and without grooves.
Figure 4:
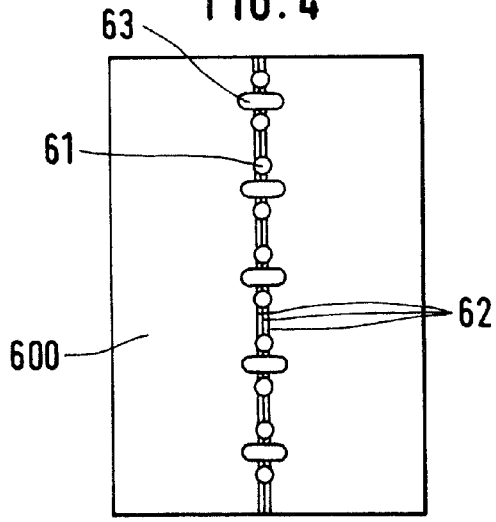
Figure 5:
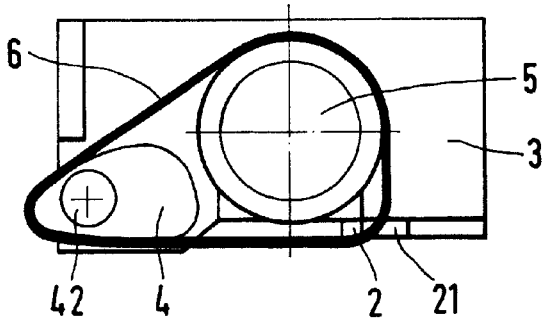
FIG. 5 shows an embodiment with a groove to lift off the small belt.

FIGS. 3 and 4 show small belt 60, 600 where, in addition to the compression holes 61, perforation openings 63 are shown extending further in the direction across the direction of fiber movement than in the direction of fiber movement. By means of these so-called transversal holes 63, the compression device is able to achieve rough compression of especially wide fiber slivers. Furthermore, the fibers are still bundled by these transversal holes 63 when the position of the fiber sliver alternates as a result of traversing movement. Gathering together over a greater width results. The transversal extension of these transversal holes 63 therefore is approximately equal to the traversing stroke or to the thereby changed position of the fiber sliver relative to the small belt 6. Transversal holes 63 and compression holes 61 are placed in regular alternation.

With the small belt 60 in FIG. 3, a transversal hole 63 is always placed between two compression holes 61. For air consumption, it is however more advantageous if the number of transversal holes 63 is smaller than the number of compression holes 61. For instance in FIG. 4, with the small belt 600, one transversal hole 63 follows every two compression holes 61. In this manner, good compression is achieved with less air consumption and traversing of the fiber sliver.

Comprehensive tests have shown that the gathering together of the fiber sliver by the suction air stream, transversally to the conveying direction, begins immediately upon emergence from the pair of output rollers, but ends after a short distance. This gathering together is independent of the staple length. Suitable design of the perforation as described above is furthermore favorable for the gathering together. It has been shown that the suction zone defined by the groove 41 need not to extend as far as the delivery cylinder 5. Shortening the suction zone furthermore increases the effect of the suction air stream in the shortened area and thereby increases the gathering together of the fiber sliver. Shortening the suction zone even allows for considerable reduction of the suction capacity while the bundling effect remains the same.

FIG. 6 shows an embodiment in which the groove 41 in the belt cage 4 extends only over less than one half of the length of the belt cage 4. The groove 41 which is connected to the suction channel 42 is located in the portion of the belt cage 4 which is away from the delivery cylinder 5 and is open towards the output cylinder of the drafting equipment. The length of this suction zone is approximately 10 to 25 mm. In this short zone, the fiber sliver is already gathered together completely. The suction zone can therefore be kept as short as possible to save suction air capacity, i.e. it is only as long as is absolutely necessary for the gathering together of the fibers. With long fiber staples, the width of the cylinder nip is greater in function of the staple length. In that case too, the suction zone may not be greater. Following the suction zone, the grooves 62 in the small belt 6 then possibly assume the cohesion or the clamping of the fibers gathered together, as described earlier.

In addition, subsequent compression may also take place between the suction zone defined by groove 43 and the nip of the delivery cylinder 5. For this purpose a channel 43 is provided which connects the groove 41 to the subsequent compression area before the delivery cylinder 5.

Figure 11:
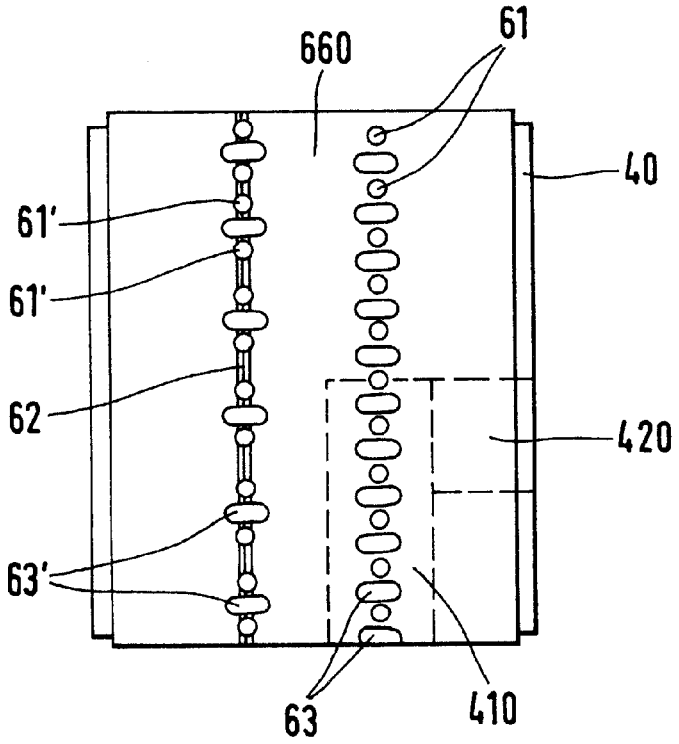
FIGS. 11 and 12 show an embodiment of the compression device with two alternately usable perforations.
Figure 12:
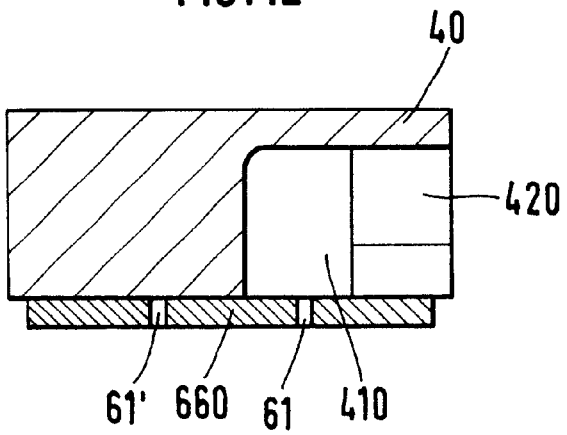

FIGS. 11 and 12 show an alternative embodiment of the compression device, in which two perforations 61 and 61' as well as 63 and 63' are provided. At the perforation 61', 63', the perforation openings are additionally connected to the grooves 62. The variants according to FIGS. 3 and 4 are combined here, but due to the asymmetrical placement of the groove 410 in the belt cage 40, always only one of the perforation rows is operating at a time. The groove 410 is connected via a suction channel 420 to the exhaust suction which is not shown.

This embodiment has the advantage that the compression device can easily be adapted to different roving thicknesses and material requirements by turning over the small belt 660. The small belt 660 is thereby more flexible in its application than a belt with only one row of perforations.

DE 43 23 472 describes that as a result of the suction air stream, it happens that fiber ends are sucked through the perforation and are then caught between the small belt 6 and the upper roller 5. This leads to annoying interference during spinning because these fibers are unable to follow the direction of the fiber sliver being twisted into a yarn. It is therefore desirable to lift the belt 6 from the delivery cylinder 5 in the output area in order to prevent this clamping of the fibers. In the above-mentioned DE 43 23 472, this lifting of the belt 6 is effected through suitable selection of the belt material. A lifting effect can however be also achieved by providing a groove in the delivery cylinder 5 under the perforation, so that the belt 6 does not lie the delivery cylinder 5 at that location. These measures require however special design of the delivery cylinder 5 or also of the belt 6. Furthermore, the belt 6 is less resistant to wear if it lacks a fabric layer.

According to the present invention, a free space is created in the run-out of the delivery cylinder 5 by providing a ridge 2 over which the belt 6 is guided immediately following the nip of the delivery cylinder 5. The ridge 2 is attached to a holder 21. The ridge 2 is adjustable by adjusting this holder 21. This ridge 2 not only serves to create clearance to prevent the catching of the fibers, but thanks to the more pronounced deflection of the belt 6, the fibers are more easily detached from the belt 6, especially when fine yarns are spun. Peeling of the fibers is avoided in any case, thus resulting in better and more uniform yarn quality.

If the suction is operating for a long period of time in the fiber bundling zone, an accumulation of fiber fly and dust in the groove 41 cannot be avoided, so that the operation of the pneumatic compression device is gradually affected. The traveling blowers normally used with ring spinning machines cannot be used for satisfactory cleaning in this case because they are only externally effective. Disassembly for cleaning of the pneumatic compression device is however very expensive.

Figure 9:
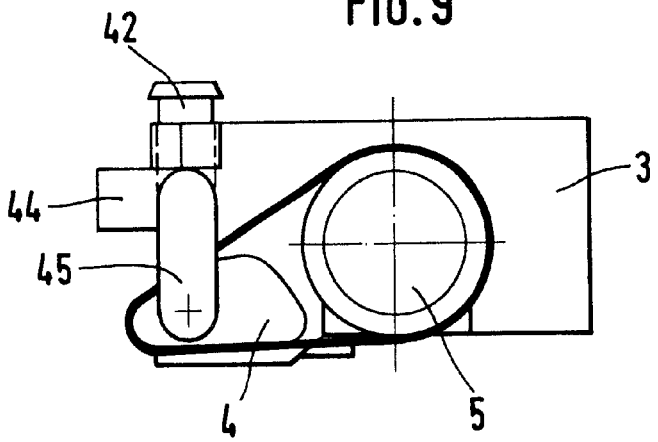
FIGS. 9 and 10 show an embodiment with cleaning device in lateral view and from above.
Figure 10:
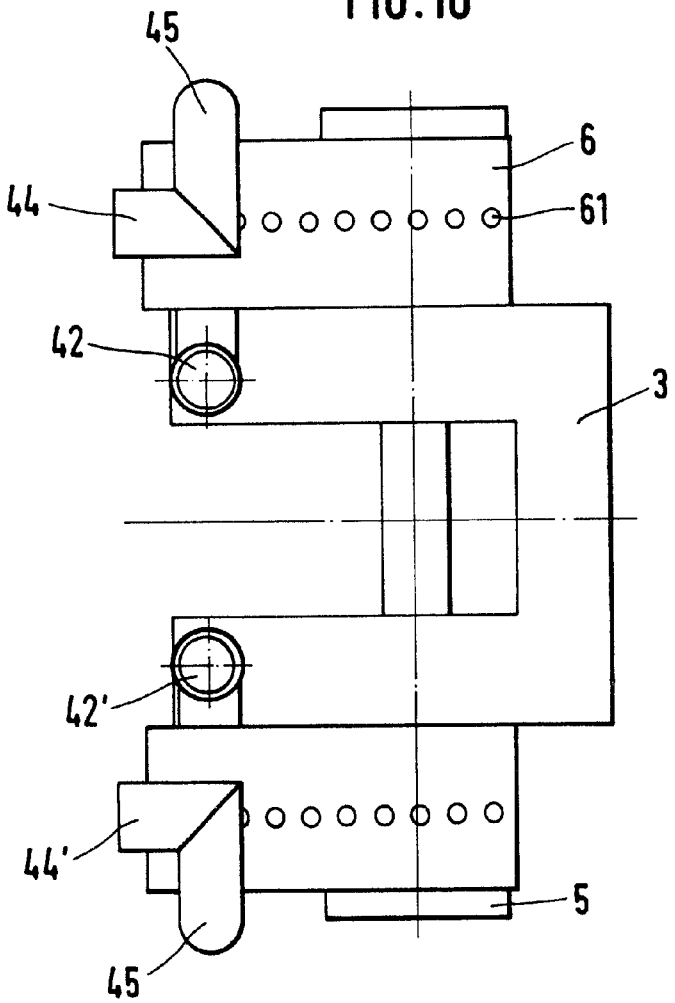

FIGS. 9 and 10 show an embodiment in which a cleaning device for the compression device is provided as seen attached to a carrier 3. A blowing air channel 45 with a connection piece 44 lets out in the belt cage 4 into the groove 41 across from the outlet of the suction air channel 42. If cleaning is to be carried out, compressed air is introduced through this blowing air channel 45, while the negative pressure through the suction air channel 42 is however maintained. It has been shown that the dirt which settles generally in the groove 41 and especially at the outlet of the suction channel 42 can be successfully removed in this manner. The compressed air is conveyed to the connection piece 44. This can be done manually but also by means of an automatic traveling carriage.

In the arrangement of FIG. 10, two compression devices having respective suction air channels 42 and 42' are attached in a pair to a carrier 3 which in turn is held in the conventional bearing arm of the drafting equipment on which the upper roller pair of the delivery cylinder 5 is also mounted in the center. To avoid the necessity for the service carriage to recognize in each instance whether the spinning station involved is on the right or on the left side of the bearing arm of the drafting equipment, the connection pieces 44 and 44' are given identical positions relative to the spinning station. Cleaning advantageously takes place in conjunction with yarn breakage repair. When the service carriage is positioned at a spinning station, the identical placement of the connection piece 44 or 44' relative to the spindle ensures that the service carriage is able to service the connection piece 44 or 44' without making a distinction. The cleaning device thus not only carries out successful cleaning of the compression device but furthermore can be easily operated by a service carriage.

Reduction of the suction effect can occur as a result of dust settling in the perforation. Also burrs at the edge of the perforation can cause fibers to get caught on them.

It has been shown that a deburred perforation operates without problems and without clogging even when the material is very dirty. Such a burr-free perforation is obtained by breaking the edges which have normally burrs as a result of the usual punching process.

It is more economical and simpler in production to make the perforation by means of a laser ray. With this production process clean and burr-free perforations are produced, and these surprisingly have no tendency to be clogged by dust or catching fibers.

It will be apparent to those skilled in the art that various modifications and variations can be made in the invention without departing from the scope and spirit of the invention. It is intended that the present invention include such modifications and variations as come within the scope of the appended claims and their equivalents.

What is claimed is:

1. A belt for a spinning apparatus for bundling together a fiber sliver comprising:

a belt defining a plurality of perforations therethrough, said perforations connected by at least one groove disposed length-wise along the perforated belt in a direction of the fiber sliver movement, said belt further comprising a plurality of traversal holes interspersed between said perforations, said traversal holes extending in a direction transverse to the direction of fiber sliver movement.

2. The belt as set forth in claim 1, wherein said belt further comprises a plurality of grooves disposed generally parallel to each other.

3. The belt as set forth in claim 2, in which the belt comprises three grooves disposed symmetrically relative to the perforations.

4. The belt according to claim 1 wherein said traversal holes are arranged alternately with said perforations.

5. The belt as set forth in claim 1 wherein one of said traversal holes falls every two said perforations.

6. A belt for a spinning apparatus for bundling together a fiber sliver comprising:

a belt defining a plurality of perforations therethrough, said belt further comprising a plurality of transversal holes interspersed between said perforations, said transversal holes extending a first distance in a direction transverse to the direction of fiber sliver movement and greater than a second distance of said transveral holes, said second distance in the direction of fiber sliver movement.

7. The belt according to claim 6 wherein said transversal holes are arranged alternatively with said perforations.

8. The belt according to claim 6 wherein one of said traversal holes falls every 2 said perforations.

9. The belt according to claim 6 wherein the traversal extension of said traversal holes are approximately equal to the traversing position of the fiber/sliver relative to the belt.

10. The belt according to claim 6 wherein the traversal holes are arranged alternatively with said perforations.

11. The belt according to claim 10 wherein the number of said traversal holes are fewer than the number of said perforations.

12. The belt according to claim 6 wherein said perforations defines a plurality of broken edges.

13. The belt according to claim 6 wherein the perforations are made by a laser.

14. The belt according to claim 6 wherein said perforated belt has 2 rows of perforations which can be assigned alternatively to an asymmetric disposed groove of the suction device.

15. The belt according to claim 6 wherein said perforations are connected by at least one groove disposed length-wise along said perforated belt.

16. The belt as set forth in claim 15 wherein said belt further comprises a plurality of grooves disposed generally parallel to each other.

17. The belt as set forth in claim 16 in which the belt comprises 3 grooves disposed symmetrically relative to the perforations.

18. The belt according to claim 15 wherein said perforations define a plurality of broken edges.

19. The belt according to claim 15 wherein the perforations are made by a laser.

20. The belt according to claim 6 wherein said plurality of perforations are free of burrs.

* * * * *